United States Patent [19]

Sietmann et al.

[11] 4,118,875

[45] Oct. 10, 1978

[54] METHOD AND MEANS OF DRYING PARTICULATE MATERIAL

[76] Inventors: Vernon H. Sietmann, Laurel, Iowa 50141; Kenneth V. Rohrs, 1154 Clarmar, Fremont, Nebr. 68025

[21] Appl. No.: 765,264

[22] Filed: Feb. 3, 1977

[51] Int. Cl.[2] ..... F26B 17/12

[52] U.S. Cl. ..... 34/174; 34/233; 432/185; 432/192

[58] Field of Search ..... 34/168, 174, 56, 233; 432/144, 150, 185, 192, 500

[56] References Cited

U.S. PATENT DOCUMENTS

| | | | |
|---|---|---|---|
| 3,237,315 | 3/1966 | Benecke | 34/174 |
| 3,365,813 | 1/1968 | Collins et al. | 34/174 |
| 3,634,949 | 1/1972 | Louks | 34/174 |
| 4,004,351 | 1/1977 | Sanneman et al. | 34/174 |

*Primary Examiner*—John J. Camby
*Assistant Examiner*—Larry I. Schwartz
*Attorney, Agent, or Firm*—Zarley, McKee, Thomte, Voorhees & Sease

[57] ABSTRACT

A portable grain drying apparatus comprising a wheeled frame having a cylindrical housing mounted thereon and extending upwardly therefrom. The housing is provided with a perforated wall portion to permit the escape of air therethrough. An inverted conical-shaped perforated lower floor is provided in the housing above the lower end thereof. The lower floor is provided with a plurality of diamond-shaped air passageways positioned thereon around a centrally disposed grain discharge opening formed in the lower floor. The air passageways also define radially extending grain passageways therebetween to facilitate the even flow of the grain on the lower floor towards the grain discharge opening. A dryer blower is mounted on the lower end of the housing for supplying heated air under pressure to the lower interior of the housing below the perforated lower floor so that a portion of the air passes upwardly through the perforated lower floor and so that a portion of the air passes upwardly through the diamond-shaped air passageways. A perforated cylindrical wall member is positioned with the housing and is spaced therefrom and from the lower floor to provide grain passageways therebetween. The upper end of the cylindrical wall is provided with a conical-shaped member extending thereover for supporting grain thereon and for permitting the passage of air upwardly therethrough. A conveyor is mounted on the housing and has one end in communication with the grain discharge opening and its other end positioned outwardly of the housing.

10 Claims, 4 Drawing Figures

Fig. 1
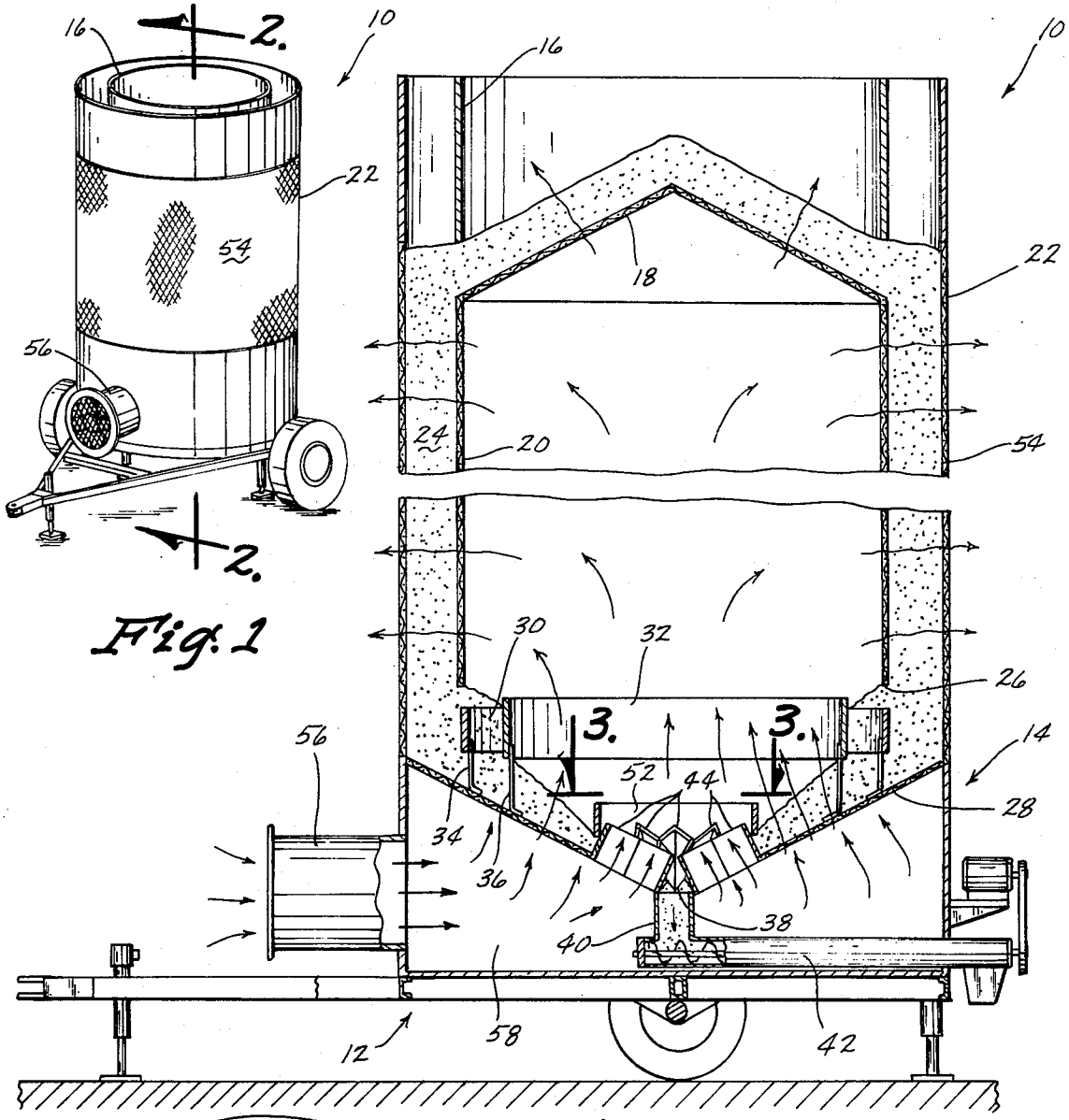
Fig. 2
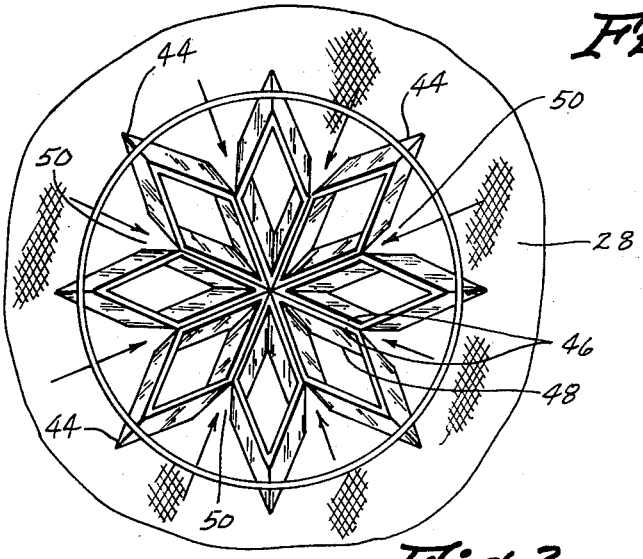
Fig. 3
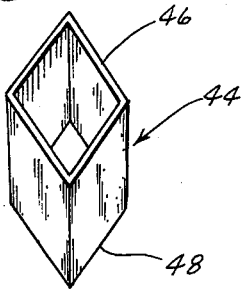
Fig. 4

METHOD AND MEANS OF DRYING PARTICULATE MATERIAL

BACKGROUND OF THE INVENTION

This invention relates to a grain dryer and more particularly to a portable grain dryer having improved efficiency.

Many types of grain dryers have been provided but the efficiency of the same is less than desirable. In some types of dryers, the gas burners are located on the side wall of the dryer and the location of the same obstructs free flow of the grain thereby. Additionally, the conventional grain dryers do not achieve satisfactory uniform grain flow on the drying floor or at the grain discharge opening which does decrease the efficiency of the same.

Therefore, it is a principal object of the invention to provide an improved grain drying apparatus.

A still further object of the invention is to provide a grain drying apparatus wherein uniform grain flow is achieved.

A still further object of the invention is to provide a grain drying apparatus wherein means is provided for achieving uniform air flow, and to reuse the drying air to conserve energy.

A still further object of the invention is to provide a grain drying apparatus including means therein for maintaining proper depth of the grain on the drying floor.

A still further object of the invention is to provide a grain drying apparatus wherein the drying air passes through the grain positioned on a lower drying floor and then passes through the grain positioned along the side wall of the apparatus.

A still further object of the invention is to provide a grain drying apparatus including a plurality of spaced-apart and radially extending grain passageways positioned at the center of a lower drying floor.

A still further object of the invention is to provide a grain drying apparatus which requires no propelling device or agitator during drying.

BRIEF DESCRIPTION OF THE DRAWINGS

FIG. 1 is a front perspective view of the grain drying apparatus of this invention:

FIG. 2 is a partial enlarged sectional view seen on lines 2—2 of FIG. 1:

FIG. 3 is an enlarged sectional view seen on lines 3—3 of FIG. 2; and

FIG. 4 is a perspective view of one of the air passageways.

SUMMARY OF THE INVENTION

The portable grain drying apparatus includes an upstanding cylindrical housing or tank mounted on a wheeled frame means. A gas burner is mounted on the side wall of the housing at the lower end thereof for supplying heated air to the lower interior portion of the housing. A perforated lower drying floor is provided within the housing above the lower end thereof and is provided with a centrally disposed grain discharge opening formed therein which is in communication with a grain auger extending outwardly from the housing. A plurality of diamond-shaped air passageways are positioned around the grain discharge opening to permit a portion of the drying air to pass upwardly therethrough into the interior of the housing. The diamond-shaped air passageways are arranged so as to define spaced-apart radially extending grain passageways therebetween which permit the grain on the perforated lower floor to flow therethrough into the grain discharge opening. Means is provided on the lower floor for maintaining the proper level or depth of grain thereon as well as maintaining the proper depth of grain around the air passageways. A perforated cylindrical wall means is mounted in the housing above the lower floor and is spaced inwardly of the housing wall to define a grain drying passageway therebetween. A conical perforated upper floor is provided on the upper end of the wall means to assist in directing the flow of grain to the grain drying passageways. The drying air is forced inwardly into the housing by the gas burner so that a portion of the air passes upwardly through the perforated lower floor and through the grain positioned thereon and so that a portion of the air passes upwardly through the diamond-shaped air passageways. The air then passes outwardly through the perforated cylindrical wall means and through the grain positioned between the cylindrical wall means and the housing wall.

DESCRIPTION OF THE PREFERRED EMBODIMENT

The grain drying apparatus of this invention is referred to generally by the reference numeral 10 and generally comprises a wheeled frame means 12 having a cylindrical housing or tank 14 mounted thereon. The upper end of housing 14 is open and is provided with a leveling ring 16 positioned at the upper end thereof as illustrated in FIG. 2 to aid in maintaining the proper depth or level of grain on the perforated upper floor 18 which is provided at the upper end of a perforated cylindrical wall 20 which is spaced inwardly from the wall 22 of housing 14 to define a grain passageway 24 therebetween. Wall 20 is supported within the housing by any conventional means so that its lower end 26 is spaced above the inverted conical-shaped lower floor 28 which is perforated to permit the flow of air therethrough as illustrated in FIG. 2.

A pair of concentric rings 30 and 32 are supported above the floor 28 by a plurality of supports 34 and 36 respectively and serve to maintain the grain on the lower floor 28 at the proper depth as illustrated in FIG. 2. Lower floor 28 is provided with a centrally disposed grain discharge opening 38 formed therein which is in communication with a tube 40 extending downwardly therefrom which is in communication with a conventional grain auger or conveyor 42 extending outwardly from the housing.

A plurality of diamond-shaped air passageway members 44 are positioned on the floor 28 around the grain discharge opening 38 in the manner illustrated in FIG. 2 so that air may pass upwardly therethrough in the manner depicted in FIG. 2. Basically, the members 44 are originally square-shaped but are deformed to achieve the diamond shape illustrated in the drawings. The members 44 are positioned on the floor 28 and the slope of the floor causes the upper ends 46 thereof to engage as illustrated in FIG. 3. However, the slope of the floor 28 and the diamond-shaped configuration of the members 44 causes the lower ends 48 thereof to be spaced apart so as to create grain passageways 50 therebetween as depicted with arrows in FIG. 3. The grain passageways 50 are spaced apart and extend radially outwardly from the grain discharge opening 38 to communicate with the grain positioned on the floor 28. The numeral 52 refers to a band extending around the upper outer ends of the members 44 to maintain the desired grain depth on the floor 28 adjacent the members 44. As also seen in FIG. 2, wall 22 of housing 14 is provided with a perforated portion 54 which is positioned outwardly of the wall 20 to permit the flow of air therethrough. The grain conveying capacity of tube 40 is greater than the collective capacities of passageways 50 to insure that movement of grain through passageways 50 will not be impeded.

In operation, the grain to be dried is supplied to the open outer end of the apparatus 10 in the manner seen in FIG. 2 so that the grain is positioned on the upper floor 18 and so that the grain passes downwardly through the passageway 24 and onto the floor 28. Ring 16 and the bands 30, 32 and 52 maintain the grain at the proper level as previously described. Gas burner 56 is then actuated so that hot air is supplied to the lower interior portion 58 of housing 14. The size of the eight air passageways 44 is such that all of the air being discharged by the burner cannot pass upwardly therethrough which results in a portion of the heated air being forced upwardly through the floor 28 outwardly of the air passageway members 44. In other words, sum of the eight air passageways 44 is less than the air input of the burner which forces air upwardly through the grain on floor 28. An air pressure differential exists between the space above and below floor 28, with the greater pressure being below the floor.

After the air has passed upwardly through the air passageway members 44 and the grain positioned on the floor 28, the air is "reused" by passing outwardly through the grain positioned on floor 18 and the grain located in the grain passageway 24 to further dry the grain. It should be noted that that portion of the grain which is located adjacent the inner surface of wall 22 in grain passageway 24 will have a lower temperature than the grain adjacent wall 20. However, the "colder" grain on the outside wall flows downwardly onto the floor 28 and will be the grain which is first subjected to the heated air passing upwardly through the floor 28. The air passageway members 44 add increased efficiency to the grain drying apparatus since the grain on the floor 28 is substantially dryer than the grain which is located in the grain passageway 24. Thus, the air passing through the grain on the floor 28 may be "reused" since it will not "pick up" excessive moisture as it passes through the grain on the floor 28.

The air passageway members 44 also serve to reduce the depth of grain in the grain passageways 50. The air movement through the grain passageways 50 accelerates the movement of the grain and makes the flow more even even if an obstruction should occur. The air passing upwardly through the grain passageways 50 eliminates the obstructions and causes the grain to flow more uniformly to achieve an equal withdrawal of grain from the grain discharge opening 38.

Thus it can be seen that a novel grain drying apparatus has been provided which uniformly injects air into the grain so that increased drying efficiency is achieved. It can also be seen that the device accomplishes at least all of its stated objectives.

I claim:

1. A grain dryer comprising, a cylindrical housing having upper and lower ends, said housing having a perforated wall portion intermediate its upper and lower ends, a perforated cylindrical wall means positioned within said housing and being spaced therefrom to define a first grain passageway therebetween, said cylindrical wall means having a conical-shaped perforated upper floor extending over its upper end, a perforated, inverted conical-shaped lower floor in said housing above the lower end thereof, said lower floor extending inwardly from said cylindrical housing, said lower floor having a grain discharge opening formed at its center, an air blower means in communication with the interior of said housing below said lower floor for supplying heated air thereto, a grain conveyor means in communication with the interior of said housing below the center of said lower floor for conveying grain from said grain discharge opening outwardly from said housing, a plurality of upstanding air passageway members positioned around said grain discharge opening and having open upper and lower ends, said lower ends of said air passageway members being in communication with the housing area below said lower floor, the upper ends of said air passageway members being in operative communication with the lower central area of said cylindrical wall means, the lower end of said cylindrical wall means being spaced above said lower floor to permit grain to flow from the lower end of said first grain passageway onto said lower floor whereby a portion of the heated air will be forced upwardly through the grain on said lower floor and whereby a portion of the heated air will pass upwardly through said air passageway members and thence outwardly through the grain in said first grain passageway and the grain on said upper floor.

2. The dryer of claim 1 wherein means is provided above said lower floor for maintaining the grain thereon in a predetermined level with respect to said air passageway members.

3. The dryer of claim 1 wherein the cumulative flow areas of said air passageway members is such that a portion of the drying air is forced upwardly through the lower floor around said air passageway members.

4. The dryer of claim 1 wherein said lower floor is perforated below said grain passageways whereby drying air is forced upwardly through said grain passageways.

5. A grain dryer comprising, a cylindrical housing having upper and lower ends, said housing having a perforated wall portion intermediate its upper and lower ends, a perforated cylindrical wall means positioned within said housing said being spaced therefrom to define a first grain passageway therebetween, said cylindrical wall means having a conical-shaped perforated upper floor extending over its upper end, a perforated, inverted conical-shaped lower floor in said housing above the lower end thereof, said lower floor extending inwardly from said cylindrical housing, said lower floor having a grain discharge opening formed at its center, an air blower means in communication with the interior of said housing below said lower floor for supplying heated air thereto, a grain conveyor means in communication with the interior of said housing below the center of said lower floor for conveying grain from said grain discharge opening outwardly from said housing, a plurality of upstanding air passageway members positioned around said grain discharge opening and having open upper and lower ends, said lower ends of said air passageway members being in communication with the housing area below said lower floor, the upper ends of said air passageway members being in operative communication with the lower central area of said cylindrical wall means, the lower end of said cylindrical wall means being spaced above said lower floor to permit grain to flow from the lower end of said first grain passageway onto said lower floor whereby a portion of the heated air will be forced upwardly through the grain on said lower floor and whereby a portion of the heated air will pass upwardly through said air passageway members and thence outwardly through the grain in said first grain passageway and the grain on said upper floor, said air passageway members being "diamond-shaped".

6. The dryer of claim 5 wherein a portion of the upper ends of adjacent air passageway members are in abutting engagement.

7. The dryer of claim 6 wherein the lower ends of adjacent air passageway members are spaced to define said spaced-apart grain passageways.

8. The dryer of claim 7 wherein said lower floor is perforated below said grain passageways whereby drying air is forced upwardly through said grain passageways.

9. A grain dryer comprising, a cylindrical housing having upper and lower ends, said housing having a perforated wall portion intermediate its upper and lower ends, a perforated cylindrical wall means positioned within said housing and being spaced therefrom to define a first grain passageway therebetween, said cylindrical wall means having a conical-shaped perforated upper floor extending over its upper end, a perforated, inverted conical-shaped lower floor in said housing above the lower end thereof, said lower floor extending inwardly from said cylindrical housing, said lower floor having a grain discharge opening formed at its center, an air blower means in communication with the interior of said housing below said lower floor for supplying heated air thereto, a grain conveyor means in communication with the interior of said housing below the center of said lower floor for conveying grain from said grain discharge opening outwardly from said housing, a plurality of upstanding air passageway members positioned around said grain discharge opening and having open upper and lower ends, said lower ends of said air passageway members being in communication with the housing area below said lower floor, the upper ends of said air passageway members being in operative communication with the lower central area of said cylindrical wall means, the lower end of said cylindrical wall means being spaced above said lower floor to permit grain to flow from the lower end of said first grain passageway onto said lower floor whereby a portion of the heated air will be forced upwardly through the grain on said lower floor and whereby a portion of the heated air will pass upwardly through said air passageway members and thence outwardly through the grain in said first grain passageway and the grain on said upper floor, said air passageway members being arranged relative to each other to define radially extending and spaced-apart grain passageways in communication with the grain on said lower floor and said grain discharge opening, and means for maintaining the grain in a predetermined level on said lower floor.

10. A grain dryer comprising, a cylindrical housing having upper and lower ends, said housing having a perforated wall portion intermediate its upper and lower ends, a perforated cylindrical wall means positioned within said housing and being spaced therefrom to define a first grain passageway therebetween, said cylindrical wall means having a conical-shaped perforated upper floor extending over its upper end, a perforated, inverted conical-shaped lower floor in said housing above the lower end thereof, said lower floor extending inwardly from said cylindrical housing, said lower floor having a grain discharge opening formed at its center, an air blower means in communication with the interior of said housing below said lower floor for supplying heated air thereto, a grain conveyor means in communication with the interior of said housing below the center of said lower floor for conveying grain from said grain discharge opening outwardly from said housing, a plurality of upstanding air passageway members positioned around said grain discharge opening and having open upper and lower ends, said lower ends of said air passageway members being in communication with the housing area below said lower floor, the upper ends of said air passageway members being in operative communication with the lower central area of said cylindrical wall means, the lower end of said cylindrical wall means being spaced above said lower floor to permit grain to flow from the lower end of said first grain passageway onto said lower floor whereby a portion of the heated air will be forced upwardly through the grain on said lower floor and whereby a portion of the heated air will pass upwardly through said air passageway members and thence outwardly through the grain in said first grain passageway and the grain on said upper floor, the lower ends of adjacent air passageway members being spaced to define said spaced-apart grain passageways; the collective grain conveying capacity of said spaced-apart grain passageways being less than the grain conveying capacity of said grain conveyor means.

* * * * *